United States Patent [19]

Heimgartner et al.

[11] 4,195,752

[45] Apr. 1, 1980

[54] APPARATUS FOR THE ESSENTIALLY UNIFORM FEED OF A FLUENT MEDIUM BY MEANS OF RECIPROCATING FEED PISTONS

[75] Inventors: Hans Heimgartner, Jona; Karl Wirz, Meilen, both of Switzerland

[73] Assignee: Haeny & Cie. AG., Meilen, Switzerland

[21] Appl. No.: 881,776

[22] Filed: Feb. 27, 1978

[30] Foreign Application Priority Data

Mar. 9, 1977 [CH] Switzerland ..... 2935/77

[51] Int. Cl.[2] ..... B67D 5/46

[52] U.S. Cl. ..... 222/61; 222/63; 222/135; 222/255

[58] Field of Search ..... 222/52, 61, 63, 135, 222/145, 255, 275, 333, 334

[56] References Cited

U.S. PATENT DOCUMENTS

| | | | |
|---|---|---|---|
| 3,185,098 | 5/1965 | Lundh | 222/334 X |
| 3,982,663 | 9/1976 | Larkin | 222/255 X |
| 4,116,364 | 9/1978 | Culbertson et al. | 222/334 X |

*Primary Examiner*—Joseph J. Rolla

*Attorney, Agent, or Firm*—Werner W. Kleeman

[57] ABSTRACT

An apparatus for the essentially uniform feed or conveying of a fluent or flowable medium by means of to-and-fro moving feed or conveying pistons, wherein there are provided at least two single-acting feed pistons. Each of the feed pistons is equipped with a forward drive and a return drive. The return velocity is greater than the forward velocity. The forward drive and return drive are driven with a phase shift such that the terminal or end portion of the feed stroke of the one feed pump overlaps the starting portion of the feed stroke of the other feed pump.

9 Claims, 10 Drawing Figures

43
42
BS
B
46
2a
45
2
2b
19
N
BD
17
18
44
21
8
7
6
R 20
5
4
3
44
41
AD
1b
14
15
16
1
1a
46
45
AS
43
A
S1
S2
S3
S4

A
B
AS
AD
BD
BS
1b
1a
2b
2a
41
42
43
44
45
46
1
2
3
4
5
6
7
8
14
15
16
17
18
19
20
21
R
S1
S2
S3
S4

A
B
AS
AD
BD
BS
41
42
43
44
45
46
1a
1b
2
2a
2b
3
4
5
6
7
8
14
15
16
17
18
19
20
21
R
S1
S2
S3
S4

43
42
BS
2b
B
46
2a
45
2
8
19
N
6
R
BD
17
18
7
44
21
8

5
20
4
44
14
15
AD
41
1b
1
16
3
46
1a
45
AS
A
43
51
52
53
54

43
BS
42
46
2a
45
B
2b
BD
44
17
18
19
21
6
7
8
R 44
20
5
4
3
41
AD
1b
46
14
15
45
16
1
1a
AS
43
A
S1
S2
S3
S4

43
42
BS
2b
B
2a
45
46
BD
17
18
19
44
21

44
20
14
15
16
41
AD
1b
46
1
1a
45
AS
43
A
R
6
7
8
5
4
3
51
52
53
54

APPARATUS FOR THE ESSENTIALLY UNIFORM FEED OF A FLUENT MEDIUM BY MEANS OF RECIPROCATING FEED PISTONS

BACKGROUND OF THE INVENTION

The present invention relates to a new and improved construction of apparatus for essentially uniformly feeding or conveying a fluent or flowable medium—hereinafter simply usually referred to as a fluent medium—by means of to-and-fro or reciprocating feed pistons.

When using reciprocating feed pistons for conveying a fluent medium there is produced an irregular, pulsating flow of the conveyed product or medium. If there is used a multi-piston pump, the pistons of which are driven in phase shifted relationship to one another, it is then possible to reduce fluctuations, but the same cannot be completely eliminated. In order to obtain an acceptable regularity in the flow of the delivered fluent medium, it is necessary to use a multiplicity of pistons. Such equipment structure is accordingly complicated and expensive.

SUMMARY OF THE INVENTION

Hence, with the foregoing in mind it is a primary object of the present invention to provide apparatus of the previously mentioned type which is not associated with the above-considered drawbacks and limitations of the prior art proposals.

Another and more specific object of the present invention aims at the provision of a new and improved construction of apparatus of the character described, wherein there can be obtained an essentially uniform feed flow of the conveyed product or medium, with a minimum number of feed pistons.

Yet a further significant object of the present invention aims at a new and improved construction of apparatus for essentially uniformly feeding or conveying a fluent medium by means of reciprocating feed pistons, which apparatus is relatively simple in construction and design, extremely reliable in operation, not readily subject to malfunction or breakdown, and requires a minimum of maintenance and servicing.

Now in order to implement these and still further objects of the invention, which will become more readily apparent as the description proceeds, the apparatus of the present development is manifested by the features that there is provided at least two single-acting feed pistons, each of which is equipped with a forward drive and a return drive, the return velocity or speed of each piston being greater than its forward or advancing velocity. Further, the forward drive device and the return drive device are driven phase shifted such that the end section or terminal portion of the feed stroke of the one feed piston overlaps the starting section or portion of the feed stroke of the other feed piston.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
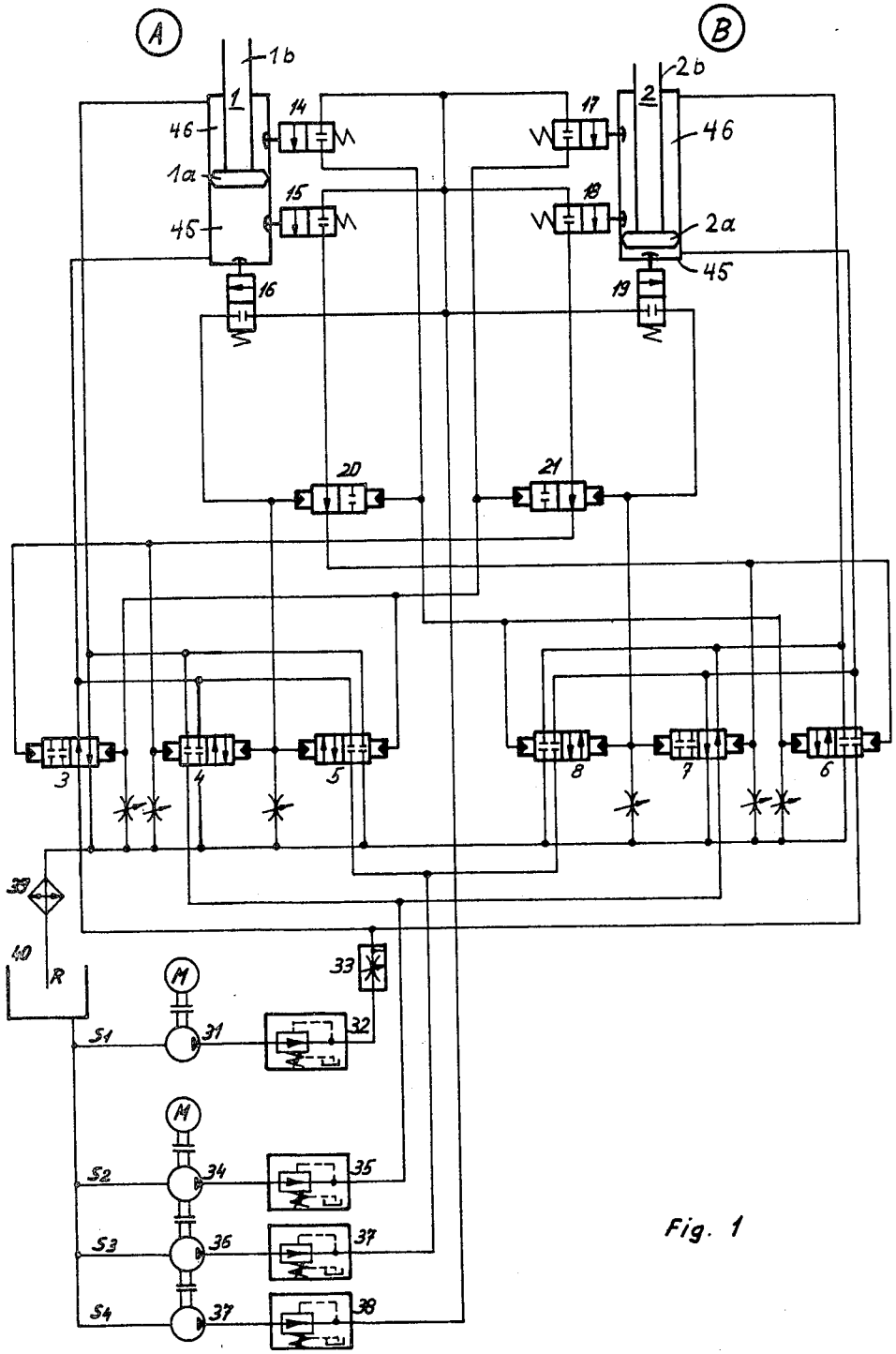
FIG. 1 is a circuit diagram of an exemplary embodiment of apparatus for essentially uniformly feeding a fluent material by means of reciprocating feed pistons.

At this point and before considering the drawings in detail, it is mentioned that by way of example there has been shown in the drawings a hydraulic driven arrangement constructed according to the teachings of the present invention, there having been conveniently used standard hydraulic symbols as are known in the art. The construction and switching of the equipment will be readily apparent from the showing of the drawings, and equally will be understood based upon the description of the system and its operation as will be given hereinafter. Accordingly, it is deemed to be adequate at this point to identify initially the individual units in conjunction with their related reference characters.

Thus, by turning to FIG. 1, it is to be understood that reference characters A and B designate two identical feed or conveyor systems, each of which possess a single-acting feed pump and a double-acting hydraulic displacement unit and associated control valves. Reference characters 1 and 2 designate combined pistons, the piston heads 1*a* and 2*a* can be impinged at both piston faces by means of a suitable working medium, here seen to be a pressurized hydraulic medium. Their piston rods 1*b* and 2*b* can immerse into a displacement vessel 41 and 42, respectively, in the manner of an immersible piston, as shown for instance in FIGS. 3–9. The displacement vessels or containers 41 and 42 are respectively connected with a suction line or conduit 43 and a pressure line or conduit 44 for the conveyed medium. In the case of the unit A, there are provided for this purpose the suction valve AS and the pressure valve AD, and in the case of the unit B there are provided the suction valve BS and the pressure valve BD.

Reference characters 3, 4, 5, 6, 7 and 8 constitute hydraulically controlled primary or main directional valves which control the medium flow at the feed or forward drive side 45 and the return drive side 46 of the pistons 1 and 2. Reference characters 14, 15, 16 and 17, 18, 19 respectively designate in each case a group of control valves, constituting signal transmitter means, which are mechanically actuated by the pistons 1 and 2 respectively. Reference character 20 constitutes a locking or blocking valve arranged after the control valve 15 and reference character 21 designates a locking or blocking valve arranged after the control valve 18.

Figure 2:
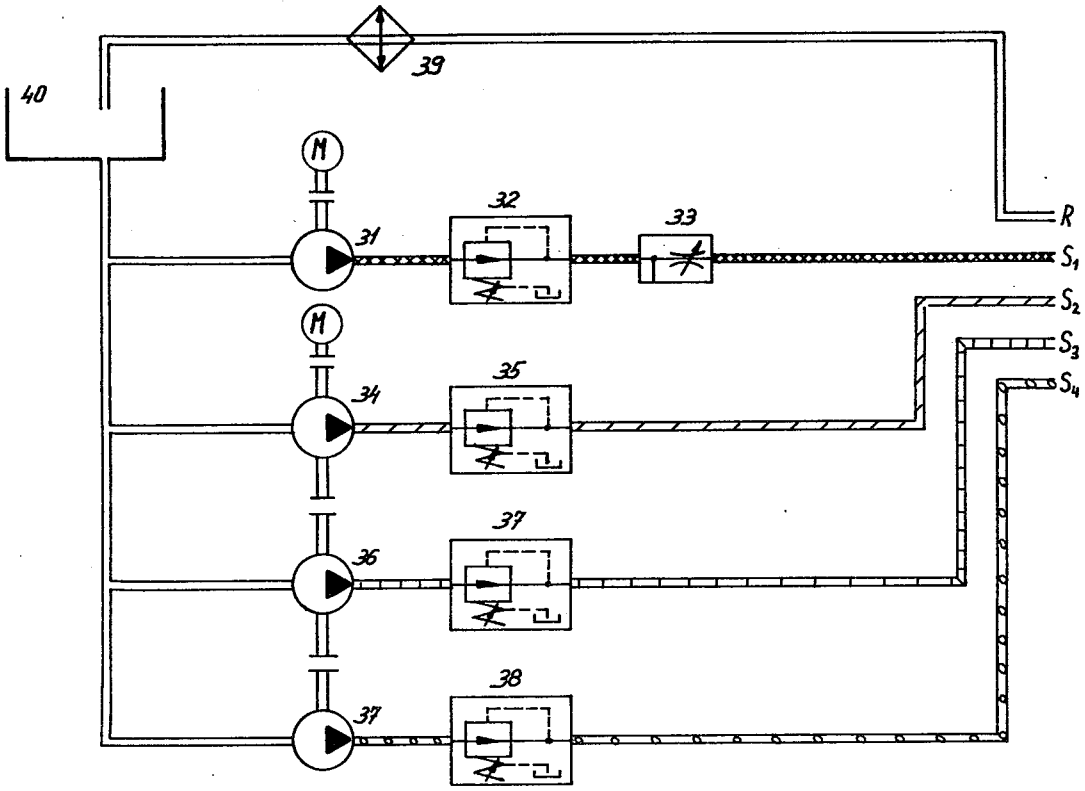
FIG. 2 schematically illustrates the power system of the apparatus of the arrangement of FIG. 1 and composed of motor driven pumps.

In the drawings, reference characters 31, 34, 36 and 37 constitute motor driven pumps, which, in their mentioned sequence, deliver the respective flow or streams of the work medium, and which have been conveniently designated by reference characters S1, S2, S3 and S4. These streams or flow of the work medium will be conveniently briefly referred to hereinafter as the effective medium flow or medium streams. Arranged after the pumps are the pressure regulating valves 32, 35, 37 and 38, and furthermore after the pump 31 a flow regulator 33. As to the setting or adjustment of the pressure regulating valves, the same will be explained more fully hereinafter. In order to complete the equipment shown in FIGS. 1 and 2, there is additionally provided a filter 39 and a tank 40.

Now in FIGS. 2–10 there have been differently graphically shown the medium streams S1, S2, S3 and S4 and the return flow stream R.

The medium stream or flow S1 serves exclusively for producing the work stroke and it can be obtained by means of constant delivery pumps, advantageously however with, for instance, constant output-regulated regulation pumps. This flow is infinitely adjustable at any random maximum pressure by means of the pressure regulator 32. Additionally, by means of the flow regulator 33 the conveying flow or stream can be infinitely set at any random value.

The medium flow S2 serves for producing the suction stroke. Hence, it is to understood that the medium flow S2 is greater than the medium flow S1. Also in this case, it is advantageous to use a regulating pump or an accumulator, in order to prevent that the medium flow, during the rest intervals, must flow-off via the pressure regulating valve 35.

The medium flow S3, as will be explained more fully hereinafter, serves to produce the piston bias and it can, as illustrated, be generated by means of a separate small pump 36 or, however, derived from the medium flow S2 by means of a flow divider. By means of the pressure regulating valve 37, there is set a pressure which is lower than the pressure minimum at the medium flow S2.

The medium flow S4 serves for controlling the primary valves. Also in this case there can be used a flow divider connected with the medium flow S2 to replace the separate pump 37. At the medium flow S4 the conveyed stream or flow is relatively small, the pressure however preferably relatively high, so that the primary valves can be exactly controlled with a control pulse. During the control operation of the primary valves there come into play not further designated throttle locations represented in the drawings by the corresponding conventional symbol. By virtue of such throttle locations or throttle means, the control valves 14–19 can be constructed as normally closed shut-off valves which can be briefly opened, when necessary, by the pistons 1 and 2 respectively. These operations will be also readily understood by referring to the teachings of the German Pat. pub. No. 2,509,712 and the corresponding U.S. Pat. No. 4,050,356 in conjunction with the illustration and description of FIG. 4. At this point, it is also mentioned that the return flow R is practically pressureless.

Figure 3:
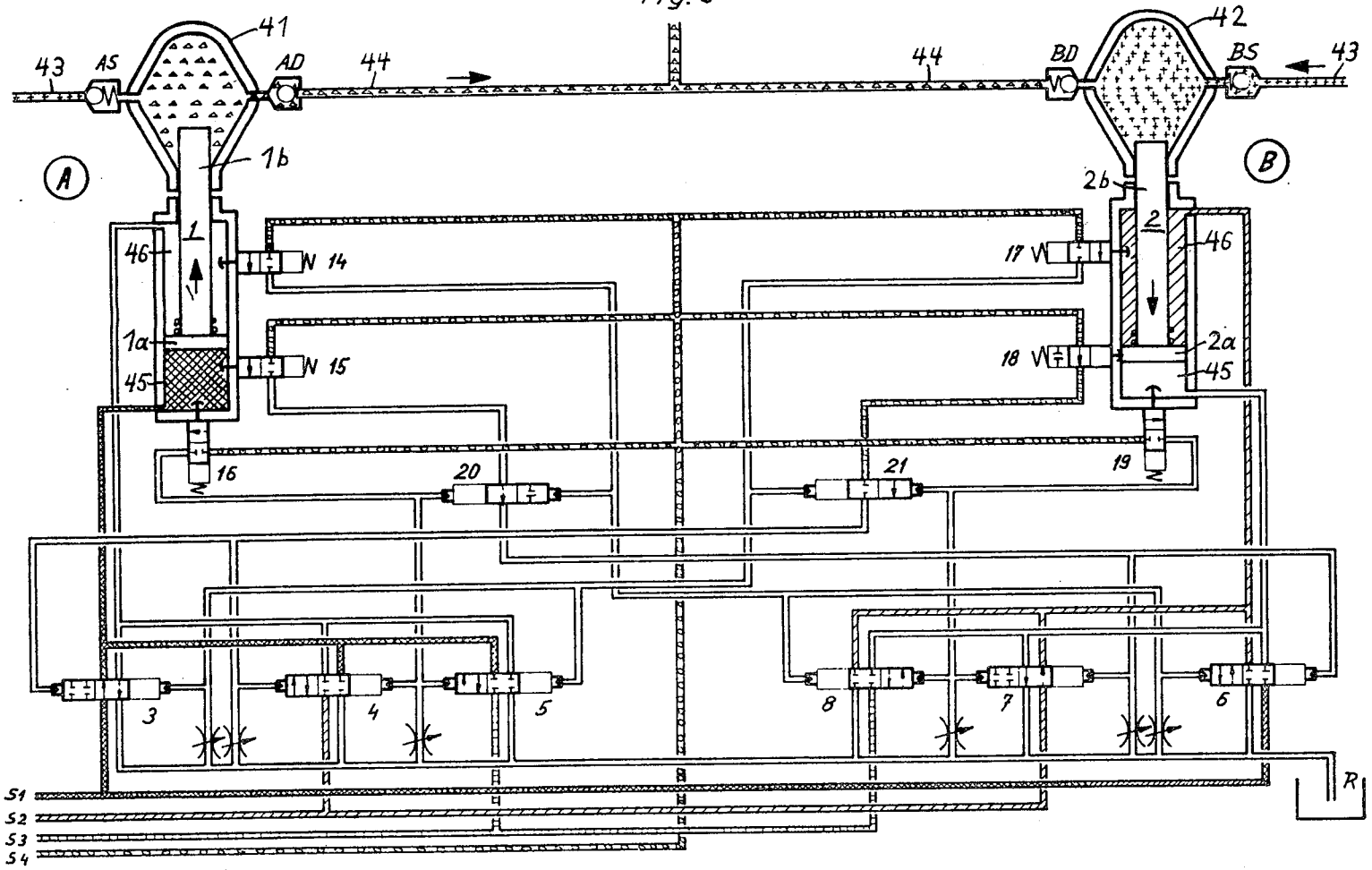
FIGS. 3–10 respectively illustrate a complete work cycle, showing the apparatus components located at different positions during explicit operating or working phases of the apparatus of the invention.

According to the showing of FIG. 3 the unit A is located in its work stroke. The medium flow which moves through the main or primary valve 3 drives the piston 1 forwardly, in the direction indicated by the arrow, and the work or conveyed material—which may be for instance an injection mixture, such as a cement or mortar mixture—is displaced out of the related displacement vessel or container 41 through the valve AD. The control valves 14, 15 and 16 are initially closed. The unit B, on the other hand, is in its suction stroke, and the conveyed material is sucked up through the valve BS. The conveyed material in the suction lines 43 and in the displacement vessel 42 is not under pressure, whereas the conveyed material located in the displacement vessel 41 and in the pressure line 44 is under pressure. The momentary pressure state of the conveyed material has been shown in FIGS. 3–10. The control valves 17 and 19 are located in their rest position, in other words, they are closed. On the other hand, the control valve 18 is actuated by the piston 2 which moves therepast and therefore the medium current S4, i.e. the control oil, flows through. Since, however, the locking valve 21 is closed, the control valve 18 during the return stroke of piston 2 does not trigger any operation. During the course of the further suction stroke also this valve 18 again recloses. The return drive of the piston 2, i.e., the piston movement during the suction stroke, is caused by the medium flow S2 which is conducted through the main or primary valve 7 to the corresponding face or side of the piston.

Figure 4:
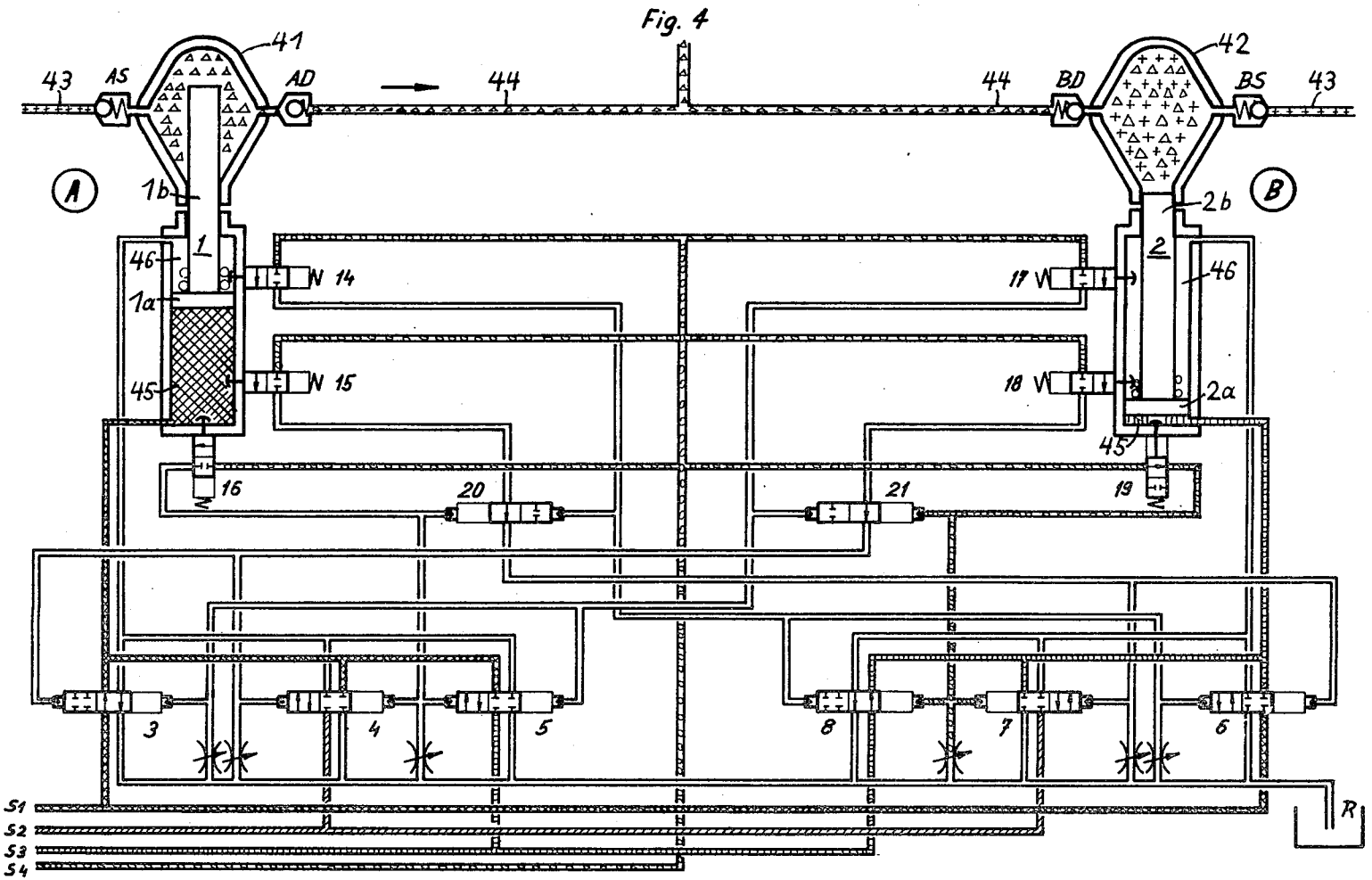

According to the showing of FIG. 4, the unit A is still located in its work stroke, whereas the valves 14, 15 and 16 are still closed. With the unit B, on the other hand, the piston 2 has terminated the suction stroke and the control valve 19 is actuated. Consequently, the locking valve 21 is switched into its second stable switching position and opened. The medium flow released by the control valve 19 furthermore switches the primary valves 7 and 8, wherein the valve 7 is closed and the valve 8 is opened. The return drive side or face of the piston is thus disconnected from the medium flow S2—this is brought about by the primary valve 7—and connected by means of the primary valve 8 with the return flow. At the same time, the primary valve 8 opens the path for the medium flow S3 to the front face or side of the piston 2, so that the latter is impinged with the pressurized oil for piston pre-biasing. This causes a slight forward stroke of the piston 2 until the control valve 19 again assumes its closed position. At the same time, there appears in the conveyed material in the displacement vessel 42 a slight pressure which acts as the closing pressure upon the valve BS. This pressure state in the vessel 42 has been shown in the drawings. With the closure of such valve there is precluded any further forward shifting of the piston 2. This operation is achieved before the piston 1 of the unit A has actuated the control valve 14. From what has been stated above it will be recognized that the piston 2 terminates its suction stroke and in the sense of the next following or feed stroke is placed under a pre-bias, before the piston 1 has terminated its work stroke.

Figure 5:
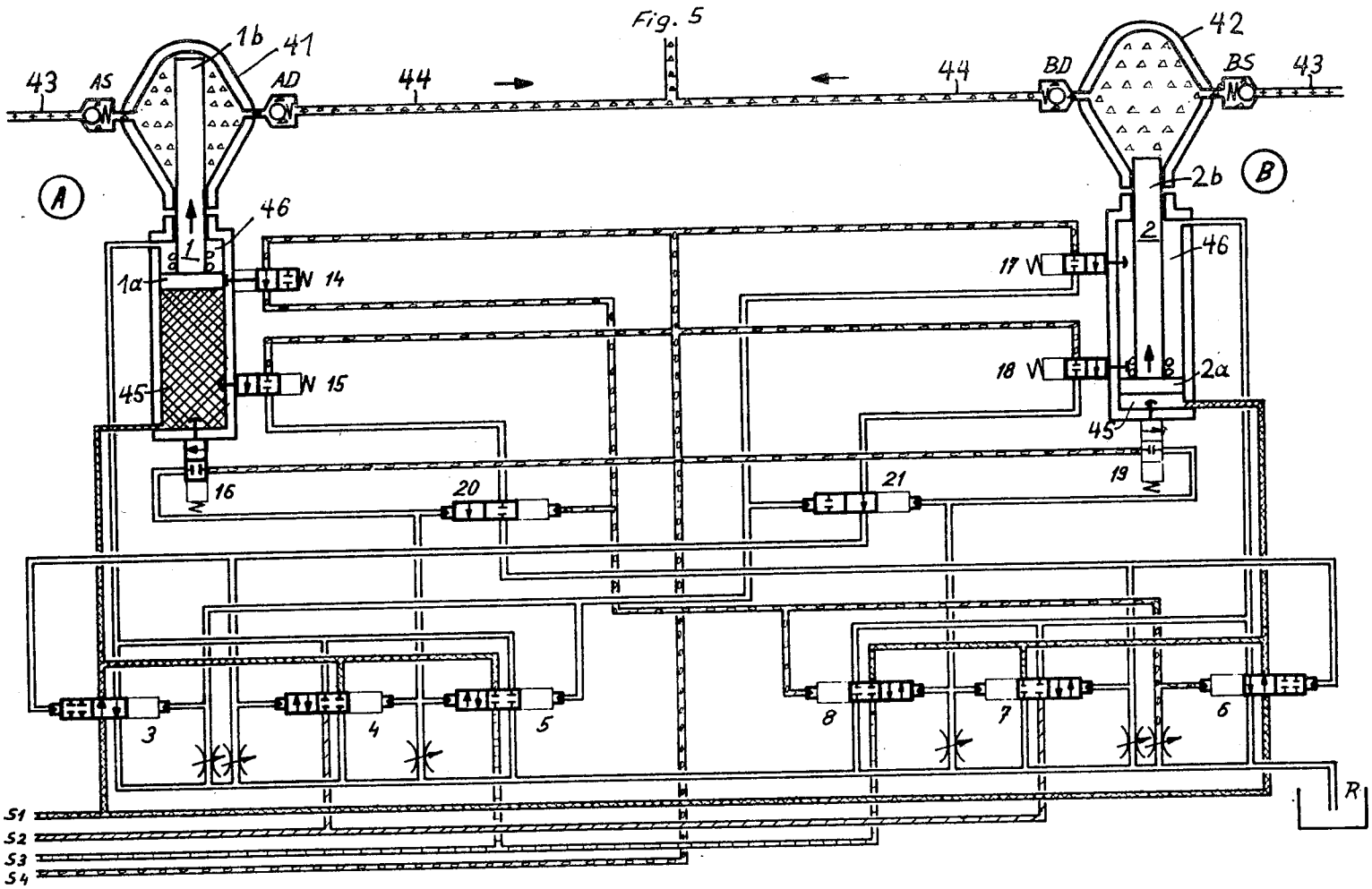

In the illustration of FIG. 5, the unit A is still located in its work stroke, wherein, however, the piston 1 has actuated and opened the control valve 14. The control oil which flows through such control valve 14 causes closure of the locking valve 20 and, thus, valve switching or reversing, and therefore, closing of the primary valve 8, and finally valve switching or reversing and, thus opening of the primary valve 6. Hence, the unit B is disconnected from the medium flow S3 and connected with the medium flow S1, i.e. with the pressurized oil for the work stroke. The medium flow S1 thus arrives, with this mode of operation, through the main or primary valve 3, just as was heretofore the case, at the unit A, but at the same time however flows through the primary valve 6 also to the unit B, so that now also the piston 2 begin s its work stroke. Since the quantity of pressurized oil has remained unchanged for the work stroke, the sum of the velocities of the pistons 1 and 2 is also equal to the velocity of the piston 1 prior to actuation of the control valve 14. If the piston 1 is braked at the end of its work stroke, for instance, as indicated, by a spring, then the piston 2 of the unit B is correspondingly accelerated, and the contribution of the unit A to the constant conveying or feed flow decreases and the part, or contribution of the unit B increases. The end of the work stroke of the piston 1 thus overlaps the start of the work stroke of the piston 2. Accordingly, the valves AS and BS are closed and the valves AD and BD are opened, since both pistons convey the feed or conveying material. The control valve 14 remains initially open, but no longer produces any further action.

Figure 6:
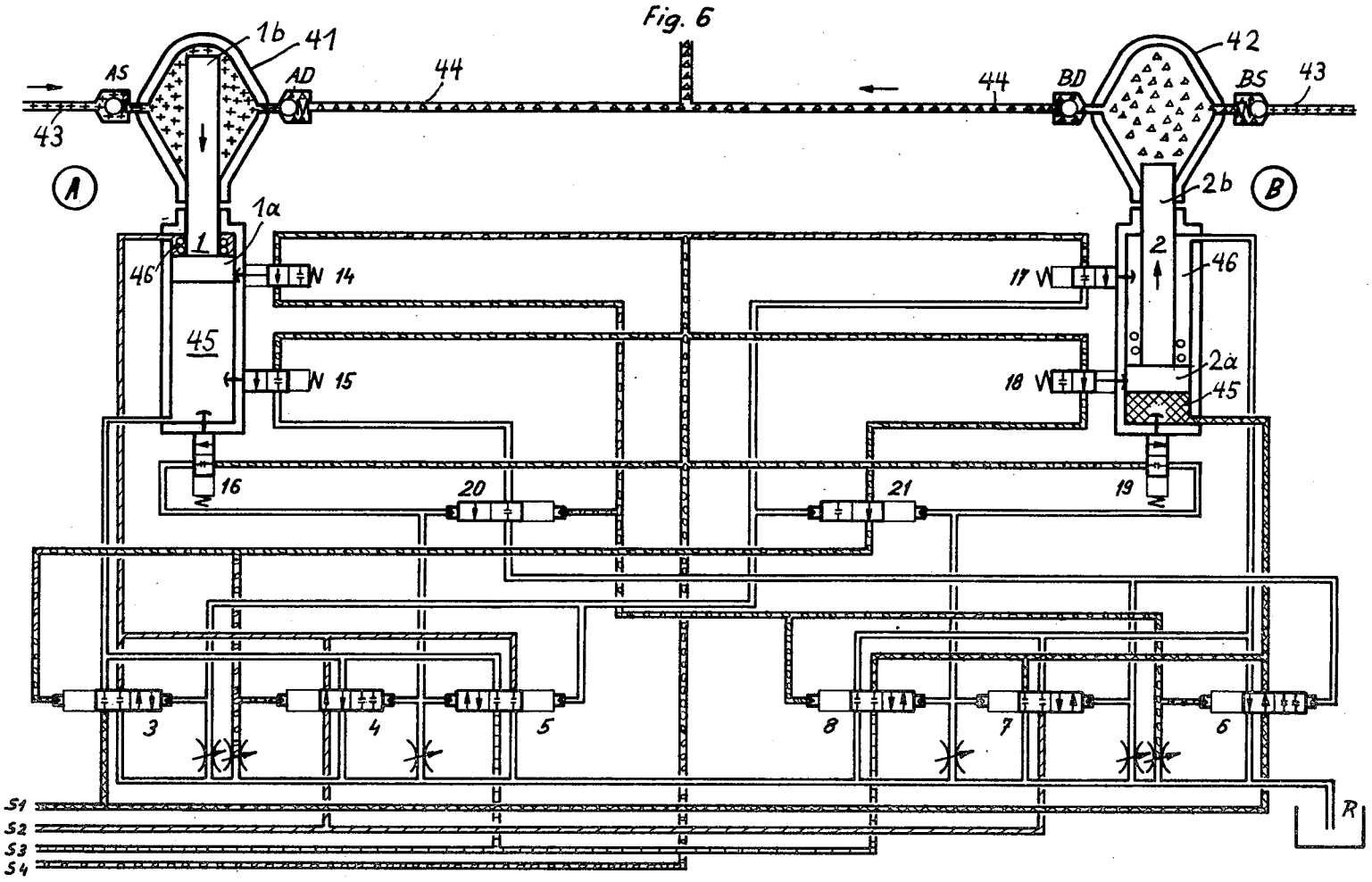

FIG. 6 illustrates that the piston 2, which in the meantime has obtained its full velocity, actuates, i.e. opens the control valve 18 soon after the start of its work stroke. Now since the locking valve 21 is open, the control oil which flows through the control valve 18 reaches the main or primary valve 3, whereby the same is switched and thus closed, and also flows to the main valve 4 which is equally switched and thus opened. The medium flow S1 now arrives unchanged at the unit B, whereas, by means of the main or primary valve 4, the medium flow S2 reaches the return drive face of the piston 1. This piston 1 is thus shifted into a relatively rapid return movement in comparison to the piston speed during the work stroke, and such action is accomplished since its forward drive face is connected with the return flow by the main or primary valve 4. Consequently, the conveyed or feed material is sucked-up through the valve AS. Immediately after the start of its return movement, the piston 1 releases the control valve 14 so that the same can close.

Figure 7:
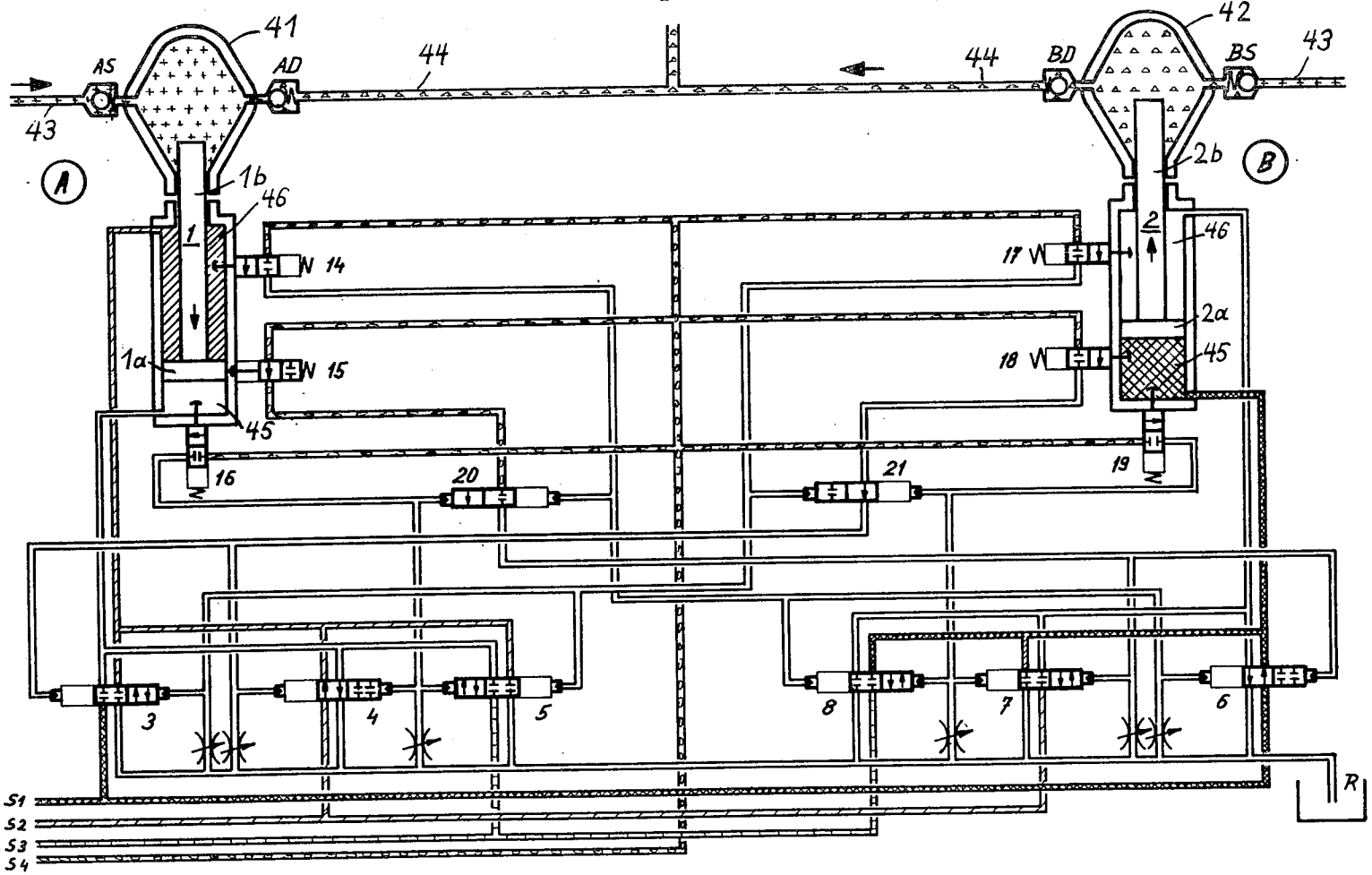

FIG. 7 shows the work phase already explained in conjunction with FIG. 3, wherein however, there have been interchanged the roles between the units A and B. What has been stated previously in conjunction with the description of FIG. 3 is also here analogously applicable. To this there may be added only the fact that the actuation of the control valve 15 by the piston 1 has no effect, since the locking valve 20 is now closed (cf. FIG. 5).

Figure 8:
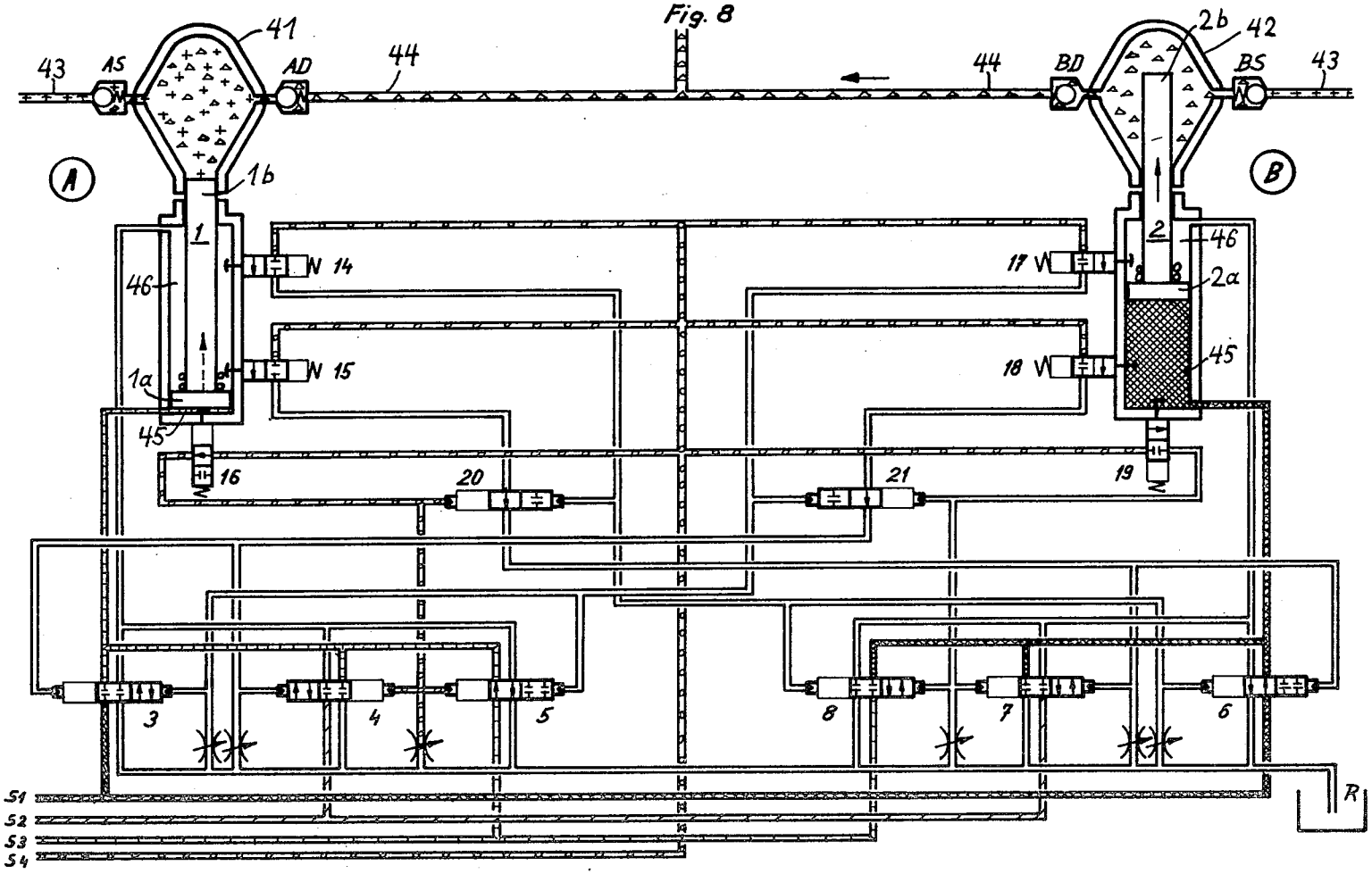

FIG. 8 corresponds to the showing of FIG. 4 except that there is an interchange of the roles played by the units A and B. With continuous work stroke of the piston 2, the piston 1 has already actuated the control valve 16, and thus, has switched the locking valve 20 and the primary valves 4 and 5, whereby the latter frees the medium flow S3 to the piston 1 and places such under a pre-bias or stress. With the switching of the locking valve 20, the control valve 15 is unlocked for its next actuation during the forward stroke of the piston 1. This has been shown in FIG. 9, corresponding to FIG. 5, with the exception that again there have been shown interchanged roles of the units A and B. There will be seen that the piston 2 closes the locking valve 21 by means of the control valve 17 and at the same time the primary valves 3 and 5 are switched. Consequently, now the medium flow S1 is conducted to the piston 1 which is placed into movement.

Figure 9:
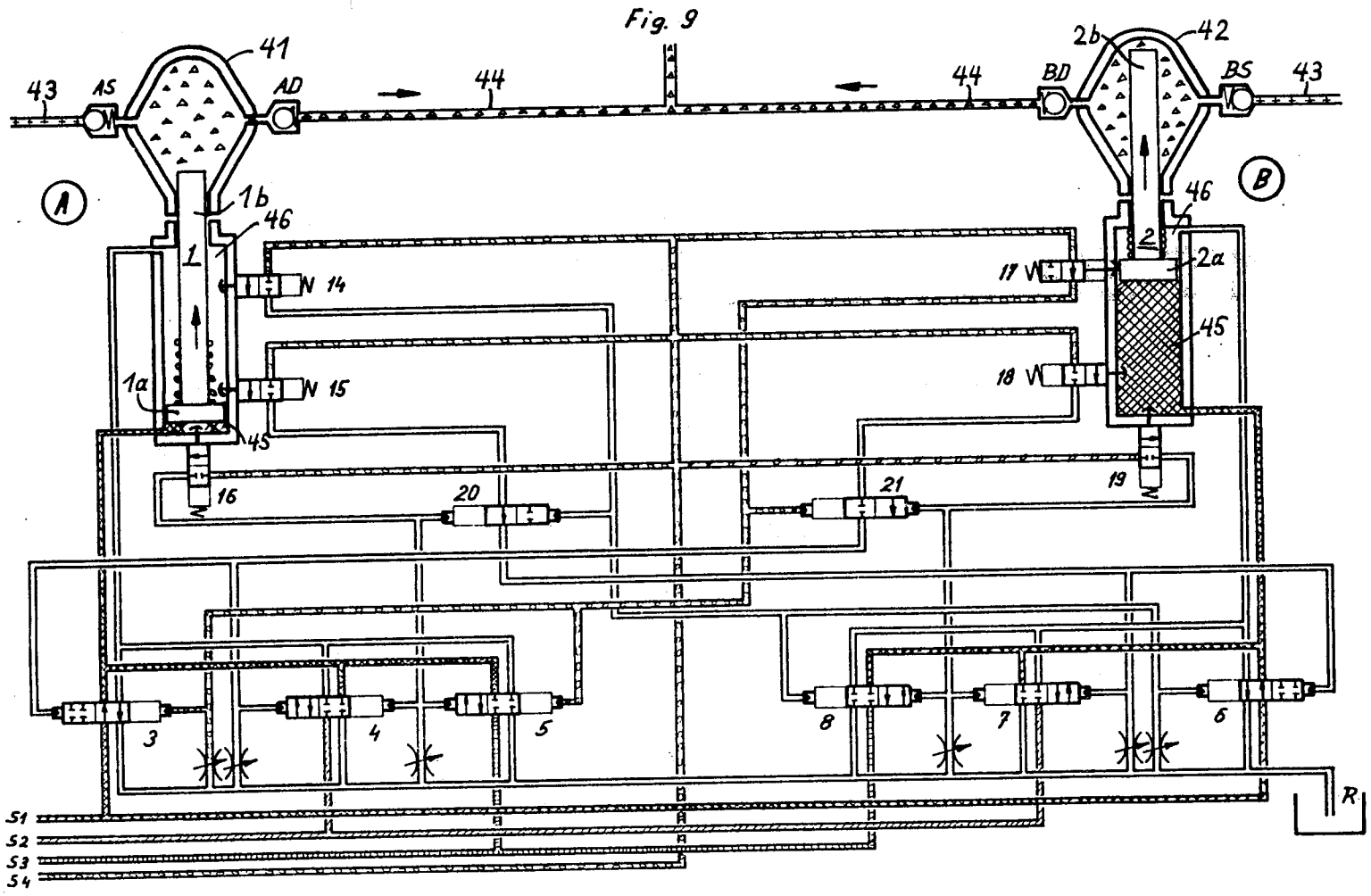
Figure 10:
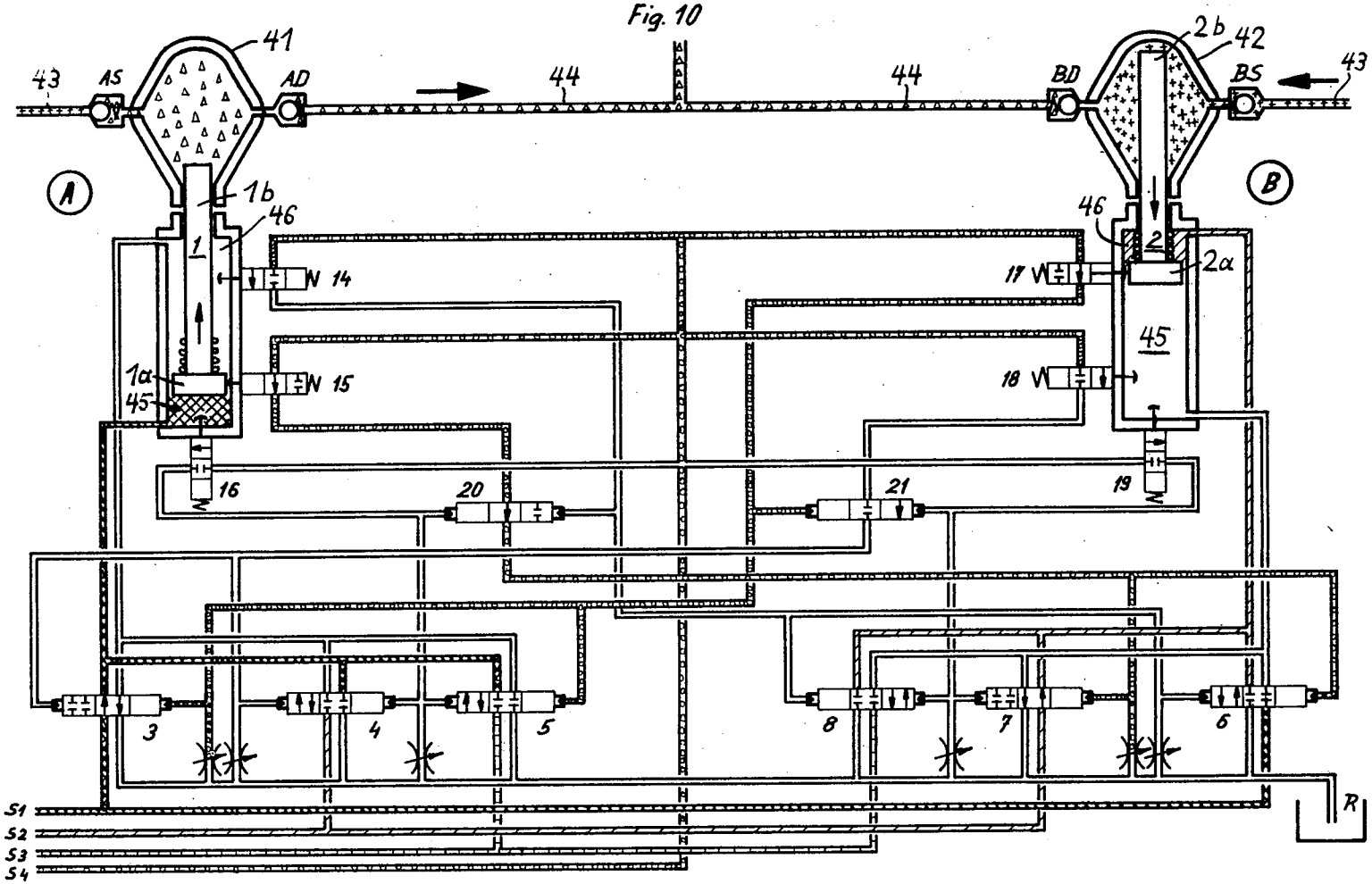

In contrast to FIG. 5, FIG. 9 no longer shows the piston 1 in its starting position, rather after having moved through the path up to the control valve 15. Hence, and as such will be apparent from FIG. 10 which corresponds analagously to the showing of FIG. 6, there is produced the switching of the primary valves 6 and 7, and the piston 2 is shifted into its rapid return movement. The new cycle now can begin anew.

With the described apparatus, and in order to summarily repeat some of its more notable features, both of the single-acting feed pumps are controlled such that during the switching phases, the one pump begins its work stroke before the other pump has terminated its work stroke. Further, the sum of the velocities of both feed pumps is essentially equal to the velocity with which one of each feed pumps moves between the time that it starts and the time that it is braked. In this way there is achieved the result that the medium flow which is available for the work stroke is divided during the switching phase for the drive of both feed pumps, wherein, however, the medium pressure and conveyed quantity per unit of time remain constant. In this way, namely due to the continuous effect of the medium flow S1, i.e., the working oil at in each case one or both pistons, there is obtained a practically uniform, pulsation-free conveying of the fed or conveyed material. Of course, it is essential that the return stroke is accomplished more rapidly than is possible in any event for a work stroke, by appropriately dimensioning the medium flow. Of importance for the smooth switching operations is also the pre-biasing or loading of the drive pistons, wherein the pre-biasing pressure of course is always smaller than the work pressure. The installation is controlled as a function of the displacement path in that the control valves are actuated by the one or the other pistons. In this regard, it is important that the control valves 15 and 18 are locked or closed during the return stroke and only effective during the forward stroke.

As a matter of further clarity it is possible also to recapitulate a work cycle as follows:

At the end of the return stroke of the pistons such trigger a preparatory signal (control valves 16, 19). Upon reaching the end portion or section of the forward stroke each piston triggers a start command (control valves 14, 17), and the other piston is placed into movement. After having started the forward stroke, each piston triggers a completion signal (control valves 15, 18), and the return stroke of the other relevant piston is then initiated.

It should be understood that the illustrated hydraulic installation also can be electrically controlled. Furthermore, it should be understood that analagous to the previously described solution, it would be conceivable to employ a purely electrical solution or electromechanical solution.

The described circuit and the switching operations can, of course, be easily reconstructed on the basis of FIG. 1. In this figure, there also can be recognized the role of the throttles or throttle locations correlated to the primary valves 3, 4, 5 and 6. As also has been explained in the previously mentioned patents, these throttles allow the use of simple shut-off valves as the control valves, which upon opening the same free a medium flow which, owing to the throttling action, delivers a throttle pulse sufficient for switching the primary valves, however can flow through the throttle locations after closing the corresponding control valve, so that the relevant primary valve is relaxed, i.e. no longer under load, in order to carry out an opposite switching operation.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. An apparatus for essentially uniformly conveying a fluent medium by means of reciprocating feed pistons, comprising:

at least two single-acting feed pistons each movable through a forward feed stroke and a return suction stroke;

a respective forward drive and return drive provided for each said feed piston;

said forward drives comprising a common first pressurized medium source which produces a pressurized medium flow at essentially constant pressure and at essentially constant feed quantity per unit of time;

said return drives comprising a second pressurized medium source;

said forward drive and return drive of each said feed piston producing a piston return velocity which is greater than the piston forward velocity;

said forward drive and return drive being operated phase shifted such that a terminal section of the feed stroke of one feed piston overlaps with a starting section of the feed stroke of the other feed piston.

2. The apparatus as defined in claim 1, further including:

respective signal transmitter means arranged in spaced relationship from the terminal position of the feed stroke of each related feed piston;

each said signal transmitter means being actuated at the start of said terminal section of the feed stroke by the related feed piston;

each said signal transmitter means, when actuated by the related feed piston moving in its forward feed direction, producing a start command for turning on the forward drive of the other feed piston.

3. The apparatus as defined in claim 2, further including:

a second respective signal transmitter means arranged at a spacing from the terminal position of the suction stroke of each feed piston;

each said second signal transmitter means determining the end of said starting section of the feed stroke and being actuated by the related feed piston;

each said second signal transmitter means, when actuated by the related feed piston moving in the forward feed direction, producing a completion signal for turning on the return drive of the other feed piston.

4. The apparatus as defined in claim 3, further including:

a respective third signal transmitter means arranged at the terminal position of the suction stroke of each feed piston;

each said third signal transmitter means being actuated by the related feed piston;

each said third signal transmitter means, when actuated by the feed piston located in its suction stroke-terminal position, triggering a preparatory signal which causes a movement of such feed piston out of the suction stroke-terminal position through a certain distance in the forward feed direction.

5. The apparatus as defined in claim 1, wherein: said apparatus conveys an injection mixture.

6. The apparatus as defined in claim 5, wherein: said injection mixture is a cement mixture.

7. The apparatus as defined in claim 5, wherein: said injection mixture is a mortar mixture.

8. An apparatus for essentially uniformly conveying a fluent medium by means of reciprocating feed pistons, comprising at least two single-acting feed pistons each movable through a forward feed stroke and a return suction stroke;

a respective forward drive and return drive provided for each said feed piston;

said forward drive and return drive of each said feed piston producing a piston return velocity which is greater than the piston forward velocity;

said forward drive and return drive being operated phase shifted such that a terminal section of the feed stroke of one feed piston overlaps with a starting section of the feed stroke of the other feed piston;

respective signal transmitter means arranged in spaced relationship from the terminal position of the feed stroke of each related feed piston;

each said signal transmitter means being actuated at the start of said terminal section of the feed stroke by the related feed piston;

each said signal transmitter means, when actuated by the related feed piston moving in its forward feed direction, producing a start command for turning on the forward drive of the other feed piston;

a second respective signal transmitter means arranged at a spacing from the terminal position of the suction stroke of each feed piston;

each said second signal transmitter means determining the end of said starting section of the feed stroke and being actuated by the related feed piston;

each said second signal transmitter means, when actuated by the related feed piston moving in the forward feed direction, producing a completion signal for turning on the return drive of the other feed piston;

a respective third signal transmitter means arranged at the terminal position of the suction stroke of each feed piston;

each said third signal transmitter means being actuated by the related feed piston;

each said third signal transmitter means, when actuated by the feed piston located in its suction stroke-terminal position, triggering a preparatory signal which causes a movement of such feed piston out of the suction stroke-terminal position through a certain distance in the forward feed direction;

each forward drive and return drive comprising a pressure medium-actuated double-acting displacement unit operatively connected with said feed pistons;

each said displacement unit having a forward side and a return side;

a common first pressurized medium source which produces a pressurized medium flow at essentially constant pressure and at essentially constant feed quantity per unit of time;

a first primary valve arrangement for connecting the forward side with said first pressurized medium source;

a second pressurized medium source;

a second primary valve arrangement;

the return side being connected by means of said second primary valve arrangement with said second pressurized medium source; and said first, second and third signal transmitter means constitute part of a control for controlling the primary valve arrangements.

9. The apparatus as defined in claim 8, further including:

a third pressurized medium source;

a respective third primary valve arrangement for connecting the third pressurized medium source with the forward side of each displacement unit;

said third pressurized medium source producing a pressurized medium flow at a pressure which is smaller than the pressure of the pressurized medium flow produced by the first pressurized medium source; and said third primary valve arrangement being switched into its open position by a preparatory signal generated by the associated third signal transmitter means.

* * * * *